US007654791B2

(12) United States Patent
Werner

(10) Patent No.: US 7,654,791 B2
(45) Date of Patent: Feb. 2, 2010

(54) APPARATUS AND METHOD FOR CONTROLLING A BLADE TIP CLEARANCE FOR A COMPRESSOR

(75) Inventor: Andre Werner, Munich (DE)

(73) Assignee: MTU Aero Engines GmbH, Munich (DE)

( * ) Notice: Subject to any disclaimer, the term of this patent is extended or adjusted under 35 U.S.C. 154(b) by 337 days.

(21) Appl. No.: 11/477,294

(22) Filed: Jun. 29, 2006

(65) Prior Publication Data

US 2009/0317228 A1 Dec. 24, 2009

(30) Foreign Application Priority Data

Jun. 30, 2005 (DE) ..... 10 2005 030 426

(51) Int. Cl.
*F01D 11/20* (2006.01)

(52) U.S. Cl. ..... 415/1; 415/14; 415/128; 415/173.2; 415/173.3; 415/174.1

(58) Field of Classification Search ..... 415/1, 415/14, 126, 127, 128, 173.2, 173.3, 174.1, 415/174.2
See application file for complete search history.

(56) References Cited

U.S. PATENT DOCUMENTS 4,135,851 A * 1/1979 Bill et al. ..... 415/173.3
4,247,247 A 1/1981 Thebert
4,334,822 A * 6/1982 Rossmann ..... 415/113
4,422,827 A * 12/1983 Buxe et al. ..... 416/193 A
4,683,716 A 8/1987 Wright et al.
5,203,673 A * 4/1993 Evans ..... 415/173.2
5,211,534 A 5/1993 Catlow
5,248,224 A * 9/1993 Amr ..... 415/223
5,344,284 A * 9/1994 Delvaux et al. ..... 415/173.2
5,871,333 A 2/1999 Halsey

FOREIGN PATENT DOCUMENTS

DE 101 17 231 A1 10/2002

* cited by examiner

*Primary Examiner*—Igor Kershteyn
(74) *Attorney, Agent, or Firm*—Crowell & Moring LLP

(57) ABSTRACT

An apparatus and method for controlling a blade tip clearance for a compressor of a turbo-engine, in particular of an aircraft engine, is disclosed. A blade tip clearance control device, which has a rotor and a housing surrounding the rotor forming a blade tip clearance, includes a sealing element that is movable into the blade tip clearance and an actuator unit, where the sealing element is designed as a circumferential shroud liner made of a flexible rubbery material in which at least one tubular diaphragm that is also circumferential is arranged. The diaphragm is acted upon with hydraulic fluid via the actuator unit. This makes it possible to counteract degradation that occurs during operation due to erosion, aging, etc. As a result, efficiency is maintained and the pump limit interval is retained.

20 Claims, 1 Drawing Sheet

APPARATUS AND METHOD FOR CONTROLLING A BLADE TIP CLEARANCE FOR A COMPRESSOR

This application claims the priority of German Patent Document No. 10 2005 030 426.5, filed Jun. 30, 2005, the disclosure of which is expressly incorporated by reference herein.

BACKGROUND AND SUMMARY OF THE INVENTION

The invention relates to a blade tip clearance control device for a compressor of a turbo-engine, in particular an aircraft engine, the control device having a rotor and a housing surrounding the rotor, forming a blade tip clearance, the blade tip clearance control device having an actuator unit and a sealing element that can be moved into the blade tip clearance.

In turbo-engines, which include, for example, turbines, pumps, compressors or fans, the blade tip clearance between the stationary rotor housing and the rotating rotor is a source of flow losses and is thus a factor causing reduced efficiency. Flow losses occur first due to the development of eddies and flow separation in or on the blade tip clearance, which also results in increased flow noise, and also due to a compensating flow directed opposite the main direction of flow through the rotor, thereby limiting the pressure difference that can be achieved between the high-pressure and the low-pressure sides of the turbo-engine.

In an ideal loss-free turbo-engine, there would be no blade tip clearance. In practice, however, this is impossible because in this case the tips of the rotor blades would come in contact with and rub against the housing and would thus cause wear when the rotor is in rotation. This problem is especially pronounced in turbo-engines in which the rotors rotate at high speeds and/or are exposed to high temperatures, as in aircraft engines, gas turbines and exhaust gas turbochargers. In such turbo-engines, the rotor blade lengthens as a function of temperature and rotational speed. In addition, the housing becomes wider as a function of operating temperature. The expansion of the housing and the lengthening of the rotor blades are compensated by the blade tip clearance without resulting in any damage to the turbo-engine.

The width of the blade tip clearance and thus the losses by the turbo-engine consequently change as a function of the rotational speed and temperature in the most recent operating state of the turbo-engine.

In practice, the blade tip clearance is usually adjusted so that the smallest possible blade tip clearance occurs at a continuous operating point at which the turbo-engine is usually operated. In aircraft engines or in exhaust-driven turbochargers, this continuous operating point occurs at the scheduled speed. At the same time, load limit ranges and startup ranges of the turbo-engine are taken into account in determining the dimensions of the blade tip clearance in practice: the blade tip clearance should be of dimensions such that damage to the rotor blade and housing can be prevented with acceptable flow losses even under extreme conditions.

In practice, a certain wear on the housing and rotor blade due to startup of the turbo-engine or operation of the turbo-engine in the load limit range is accepted in favor of achieving the highest possible efficiency.

Several approaches have been proposed in the state of the art for achieving optimum blade tip clearance, i.e., a blade tip clearance width at which wear and flow losses are minimal, in all operating ranges of the turbo-engine.

U.S. Pat. No. 4,247,247 describes an axial turbo-engine in which the housing has a ring with a thin flexible wall opposite the rotors. Different pressures can be applied to the annular pressure chambers situated behind the thin wall. If the pressure in the pressure chambers exceeds the pressure in the axial flow turbine, the wall will bulge in a controlled manner and thereby reduce the blade tip clearance. The pressure chambers are thus put under pressure in such a way that the blade tip clearance is reduced in the direction of flow.

In the case of the gas turbine according to U.S. Pat. No. 4,683,716, the housing wall along with several rows of stator blades is pneumatically adjusted over several compressor stages. To do so, a pressure chamber is provided from behind the housing wall, which extends over a plurality of rows of rotors and stators. By supplying a low pressure or a high pressure to the pressure chamber, this prevents the rotor blades from rubbing against the housing wall in startup operations.

In U.S. Pat. No. 5,211,534, the blade tip clearance is again adjusted pneumatically. A sealing ring around the rotor composed of radially displaceable ring segments around the rotor is contracted or widened under the influence of compressed air to fit onto the rigid ring segments.

The device according to U.S. Pat. No. 5,871,333 has housing segments that are moved in the direction of the rotor blades by compressed air acting on pressure chambers. To increase the response, the pressure chamber is equipped with bleeder valves for rapid equalization of pressure.

The disadvantage of the systems according to U.S. Pat. No. 4,247,247, U.S. Pat. No. 4,683,716, U.S. Pat. No. 5,211,534 and U.S. Pat. No. 5,871,333 is that each of these provides a complex solution comprised of multiple components. Retrofitting to implement such designs in existing aircraft engines is impossible. Furthermore, rapid and selective adjustment of blade tip clearance with the aforementioned devices is also impossible.

German Patent Document No. DE 101 17 231 A1 describes an improved approach. In this case, a blade tip clearance control module for a turbo-engine having a rotor and a housing that surrounds the rotor, forming a blade tip clearance, is described. The blade tip clearance control module is equipped with an actuator unit that acts on a sealing element and moves it into or out of the blade tip clearance. To increase the response, the sealing element is designed to be smaller than the distance between two successive rotor blades. One disadvantage here is that many actuators are required and the clearance control module is interrupted.

In summary, the related art cited above does not disclose any device that can be manufactured easily and inexpensively, with which the response allows rapid adjustment of blade tip clearance and which can be incorporated into existing jet engines by retrofitting.

The object of the present invention is therefore to improve upon the blade tip clearance control devices mentioned initially for use in compressors accordingly. This should counteract degradation due to erosion, aging, etc., that occurs during operation. As a result, the efficiency should be maintained and the pump limit interval should be retained.

According to the present invention, the sealing element is designed as a circumferential shroud liner made of a flexible rubbery material in which there is at least one tubular diaphragm that is also circumferential and can be acted upon by hydraulic fluid via the actuator unit. It has proven advantageous here to use three tubular diaphragms, the central diaphragm having a circular cross-section and the two outer tubular diaphragms having an oval cross-section. Since the shroud liner is embodied as a flexible material, this achieves the result that non-uniform expansion of the blading can be compensated without damage. In this case, spots of shroud liner material are worn away by the blades without resulting in damage to the blades.

According to an advantageous embodiment of the present invention, the shroud liner is accommodated in a circumferential recess in the compressor housing. This recess may be abraded from the inside wall of the housing by a machining method, for example.

According to another advantageous embodiment of the present invention, the shroud liner is made of silicone rubber. Silicone rubber has good physical material properties. For example, silicone rubber may be used for prolonged periods of time at temperatures up to 140° C. and temporarily even at temperatures up to 270° C. Silicone polymers are characterized in particular by a high thermal stability and excellent elasticity in a temperature range from −50° C. to 270° C.

According to another advantageous embodiment of the invention, the actuator unit is designed as a pneumatic adjusting unit that acts on at least one tubular diaphragm. The actuator unit may be designed as a regulating valve for supplying compressor exhaust air.

According to another advantageous embodiment of the invention, a regulating unit is provided for controlling the compressed air. In this way, the compressed air flow rate may be adapted to the actual clearance width, which permits a greater accuracy than that based on clearance width curves stored in advance.

According to another advantageous embodiment of the present invention, a sensor unit connected to the control unit is provided for measuring the blade tip clearance. In this way, the regulating unit may be supplied with a feedback signal.

An embodiment of the inventive method for controlling the width of a blade tip clearance in a compressor of a turbo-engine where a circumferential shroud liner made of flexible rubbery material with a tubular diaphragm, also circumferential, is provided, has the following steps:

determining the blade tip clearance using a sensor unit;

calculating the required expansion of the tubular diaphragm for closing the blade tip clearance in the regulating unit;

moving the shroud liner into the blade tip clearance by means of hydraulic fluid acting on the tubular diaphragm; and repeating the aforementioned process steps until the sensor unit has detected a predetermined clearance width.

BRIEF DESCRIPTION OF THE DRAWINGS

Other measures that improve the present invention are explained in greater detail below together with the description of a preferred exemplary embodiment of the present invention with reference to the drawing figures, in which.

DETAILED DESCRIPTION OF THE DRAWINGS

Figure 1:
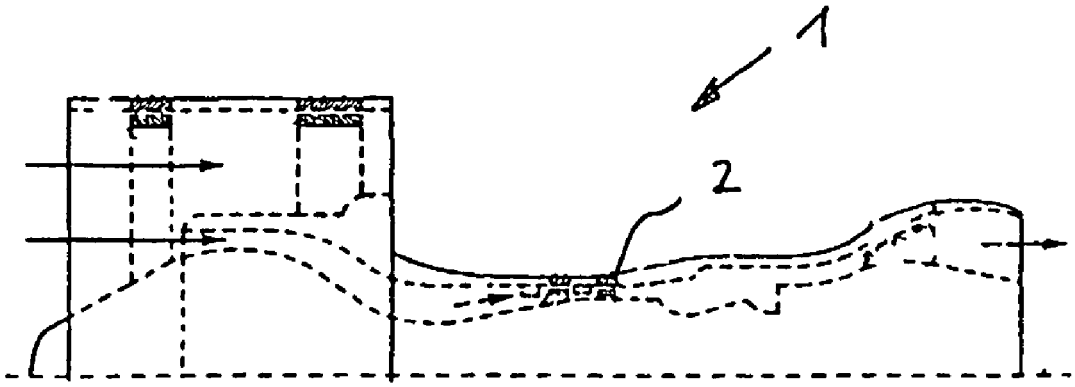
FIG. 1 is a schematic half-section through an axial turbo-engine with a compressor.

The figures that follow are schematic diagrams and serve to illustrate the present invention. The same and similar parts are labeled with the same reference notations. The directional information refers to the plane of the drawing unless otherwise indicated.

FIG. 1 shows a schematic half-section through an aircraft engine 1 having axial flow through it with a compressor and a blade tip clearance control device 2.

Figure 2:
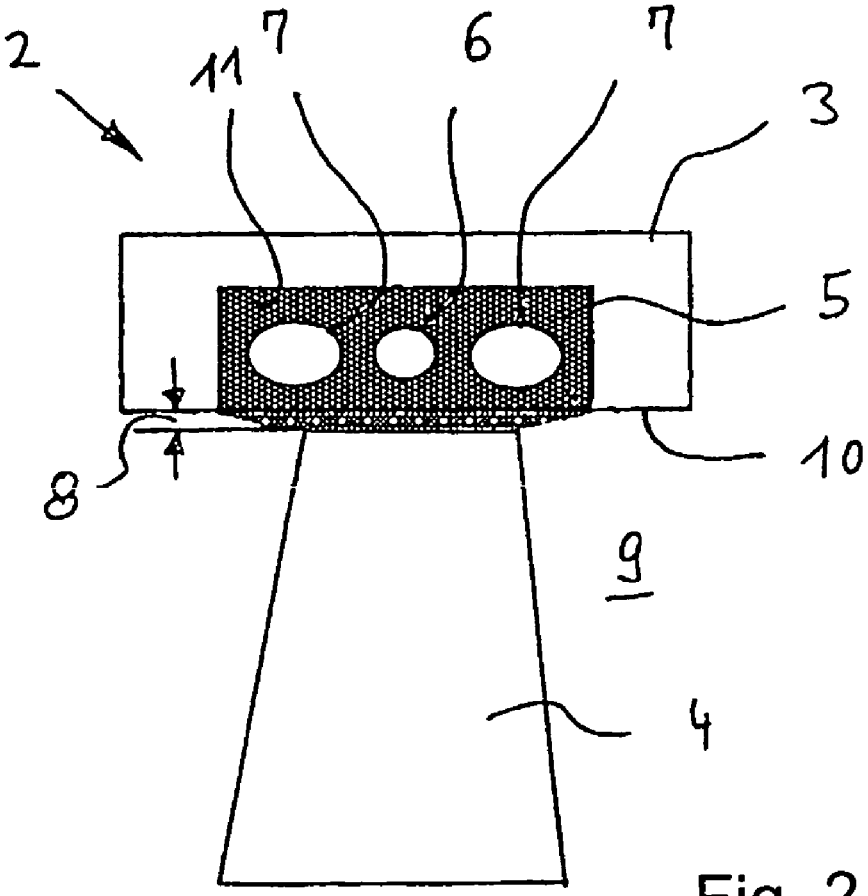
FIG. 2 is a schematic detail of a sectional view through an inventive embodiment of a blade tip clearance control device.

FIG. 2 shows a schematic detail view through an inventive embodiment of a blade tip clearance control device 2. A compressor rotor having compressor blades 4 rotates in a compressor housing 3. A circumferential recess 11 is cut in the compressor housing 3, with a circumferential shroud liner 5 of silicone rubber being applied to the recess. The circumferential shroud liner 5 having an essentially rectangular cross-section has a central tubular diaphragm 6 on the inside with a round cross-section and two outer tubular diaphragms 7 with an oval cross-section. The side of the shroud liner 5 facing the flow channel 9 is sealed with the inside wall 10 of the housing when not in operation and goes beyond it only during operation, as illustrated in FIG. 2.

A blade tip clearance 8 is formed between the compressor housing 3 and the compressor blades 4. This blade tip clearance 8 varies according to the operating point of the turbo-engine, i.e., partial load, full load, etc. By regulated pneumatic operation of the tubular diaphragms 6, 7, the shroud liner 5 is expanded accordingly and moved into the blade tip clearance 8 until the blade tip clearance 8 disappears.

LIST OF REFERENCE NUMERALS

1 aircraft engine
2 blade tip clearance control device
3 compressor housing
4 rotor blade
5 shroud liner
6 central tubular diaphragm
7 outer tubular diaphragm
8 blade tip clearance
9 flow channel
10 inside wall of housing
11 circumferential recess The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A blade tip clearance control device for a compressor of a turbo-engine, which has a rotor and a housing surrounding the rotor, forming a blade tip clearance, wherein the blade tip clearance control device has a sealing element that is movable into the blade tip clearance and an actuator unit, and wherein the sealing element is designed as a circumferential shroud liner made of a flexible rubbery material in which at least one tubular diaphragm that is also circumferential is completely disposed within the shroud liner, and further wherein the diaphragm is acted upon by hydraulic fluid via the actuator unit.

2. The blade tip clearance control device according to claim 1, wherein the shroud liner is held in a circumferential recess in the compressor housing.

3. The blade tip clearance control device according to claim 1, wherein the shroud liner is made of silicone rubber.

4. The blade tip clearance control device according to claim 1, wherein the actuator unit is designed as a pneumatic adjusting unit that acts on at least one tubular diaphragm.

5. The blade tip clearance control device according to claim 1, wherein a regulating unit is provided for controlling the hydraulic fluid.

6. The blade tip clearance control device according to claim 5, wherein a sensor unit connected to the regulating unit is provided for measuring the blade tip clearance.

7. A method for controlling the width of a blade tip clearance in a compressor of a turbo-engine, wherein a circumferential shroud liner made of a flexible rubbery material is provided with a tubular diaphragm that is also circumferential, wherein the tubular diaphragm is completely disposed within the shroud liner, and wherein the method comprises the steps of:

determining the blade tip clearance using a sensor unit;

calculating a required expansion of the tubular diaphragm for closing the blade tip clearance in a regulating unit;

moving the shroud liner into the blade tip clearance by hydraulic fluid acting on the tubular diaphragm; and repeating the aforementioned process steps until the sensor unit has detected a predetermined blade tip clearance width.

8. A blade tip clearance control device for a compressor of a turbo-engine, wherein the compressor includes a rotor and a housing surrounding the rotor, and wherein a blade tip clearance is defined between the rotor and the housing, comprising:

a sealing element disposed around a circumferential extent of the housing in a recess defined by the housing, wherein the sealing element is designed as a circumferential shroud liner and includes a circumferential tubular diaphragm, wherein the tubular diaphragm is completely disposed within the shroud liner, and wherein a portion of the sealing element is displaceable into the blade tip clearance; and an actuator unit coupled to the sealing element, wherein the actuator unit controls an expansion of the diaphragm for displacing the sealing element.

9. The blade tip clearance control device according to claim 8, wherein the actuator controls a flow of hydraulic fluid to the diaphragm.

10. The blade tip clearance control device according to claim 8, wherein the actuator controls a flow of compressor exhaust air to the diaphragm.

11. The blade tip clearance control device according to claim 8, wherein the sealing element further includes a second and a third circumferential tubular diaphragm.

12. The blade tip clearance control device according to claim 11, wherein the first circumferential tubular diaphragm is circular in cross-section and is disposed between the second and third circumferential tubular diaphragms, and wherein the second and third circumferential tubular diaphragms are oval in cross-section.

13. The blade tip clearance control device according to claim 8, wherein the sealing element is silicone rubber.

14. A method for controlling a width of a blade tip clearance in a compressor of a turbo-engine, wherein the blade tip clearance is defined by a rotor and a housing surrounding the rotor of the compressor, comprising the steps of:

expanding a circumferential tubular diaphragm disposed within a sealing element to displace a portion of the sealing element into the blade tip clearance, wherein the sealing element is designed as a circumferential shroud liner and wherein the tubular diaphragm is completely disposed within the shroud liner, and wherein the sealing element is disposed around a circumferential extent of the housing in a recess defined by the housing.

15. The method according to claim 14, wherein the step of expanding the circumferential tubular diaphragm includes the step of supplying a flow of compressor exhaust air to the diaphragm.

16. The method according to claim 14, wherein the step of expanding the circumferential tubular diaphragm includes the step of supplying a flow of hydraulic fluid to the diaphragm.

17. The method according to claim 14, further comprising the steps of expanding a second and a third circumferential tubular diaphragm disposed with the sealing element, wherein the first circumferential tubular diaphragm is circular in cross-section and is disposed between the second and third circumferential tubular diaphragms, and wherein the second and third circumferential tubular diaphragms are oval in cross-section.

18. The method according to claim 14, further comprising the step of determining the width of the blade tip clearance by a sensor.

19. The method according to claim 14, wherein the sealing element is silicone rubber.

20. The method according to claim 14, wherein the step of expanding the circumferential tubular diaphragm to displace the portion of the sealing element into the blade tip clearance is adjusted during an operation of the compressor.

* * * * *

UNITED STATES PATENT AND TRADEMARK OFFICE

CERTIFICATE OF CORRECTION

PATENT NO. : 7,654,791 B2
APPLICATION NO. : 11/477294
DATED : February 2, 2010
INVENTOR(S) : Andre Werner It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 373 days.

Signed and Sealed this

Eighteenth Day of January, 2011

David J. Kappos

David J. Kappos
*Director of the United States Patent and Trademark Office*